United States Patent [19]

Chanter

[11] 4,361,259

[45] Nov. 30, 1982

[54] WIRE BACK PACK FRAME

[75] Inventor: Alan B. Chanter, Oakville, Canada

[73] Assignee: Pathfinder Camping Products Limited, Oakville, Canada

[21] Appl. No.: 226,964

[22] Filed: Jan. 21, 1981

Related U.S. Application Data

[63] Continuation-in-part of Ser. No. 94,146, Nov. 14, 1979, abandoned.

[30] Foreign Application Priority Data

Jul. 18, 1979 [CA] Canada ..... 332047

[51] Int. Cl.[3] ..... A45F 3/10

[52] U.S. Cl. ..... 224/211; 224/212

[58] Field of Search ..... 224/153–156, 224/210–216, 261–263

[56] References Cited

U.S. PATENT DOCUMENTS

| | | | |
|---|---|---|---|
| 2,456,253 | 12/1948 | Bushey | 224/212 |
| 3,265,260 | 8/1966 | Romney | 224/212 X |
| 3,563,431 | 2/1971 | Pletz | 224/263 X |
| 3,648,907 | 3/1972 | Romney | 224/211 |
| 3,840,162 | 10/1974 | Horenstein et al. | 224/262 |
| 3,885,722 | 5/1975 | Robertson | 224/261 |
| 3,897,894 | 8/1975 | Lawrence | 224/261 |
| 4,087,031 | 5/1978 | Fenner | 224/211 |
| 4,133,464 | 1/1979 | Kelty | 224/262 |

FOREIGN PATENT DOCUMENTS

| | | | |
|---|---|---|---|
| 472755 | 1/1975 | Australia | 224/212 |
| 2649067 | 5/1978 | Fed. Rep. of Germany | 224/210 |

*Primary Examiner*—William Price
*Assistant Examiner*—Gary E. Elkins
*Attorney, Agent, or Firm*—Hirons, Rogers & Scott

[57] ABSTRACT

A back pack consists of a wire frame and belt and shoulder harnesses attached thereto. The frame is made solely from solid drawn wire members and consists of a wire perimeter frame with a wire grid extending between the perimeter frame sides. Preferably the perimeter frame is two closely spaced parallel wires, while the grid is two pluralities of parallel wires at right angles to one another and fastened to one another, e.g. by welding or adhesive, wherever they cross and touch. The perimeter slot formed by the spaced wires is subdivided into a plurality of slot portions. The harnesses are fastened to the frame by belts with buckles that can only be passed through the slots in edgewise attitude. A pack is fastened by headed pins the shanks only of which can pass through the slot portions, the pins shanks passing through grometted holes in the pack edges and being retained by a pin passing through a hole in the shank. In another preferred construction vertically extending frame members also comprise two closely spaced parallel wires; with such a construction all of the wires can be of the same diameter. Also it is preferred that the belt and shoulder harnesses tension the frame transversely, thereby adding to its rigidity under load without increase in wire diameter.

11 Claims, 7 Drawing Figures

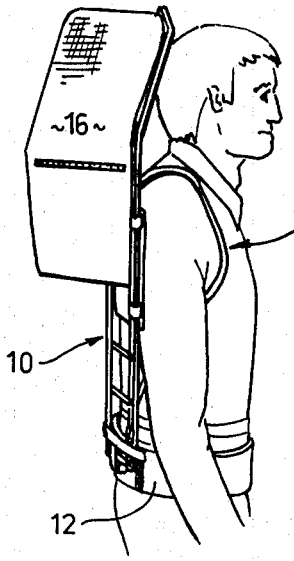
FIG. 1
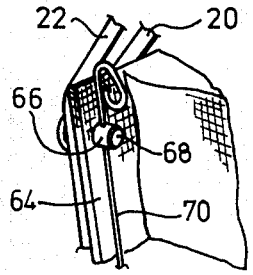
FIG. 4
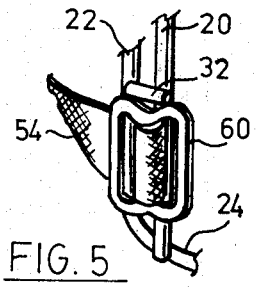
FIG. 5
FIG. 2
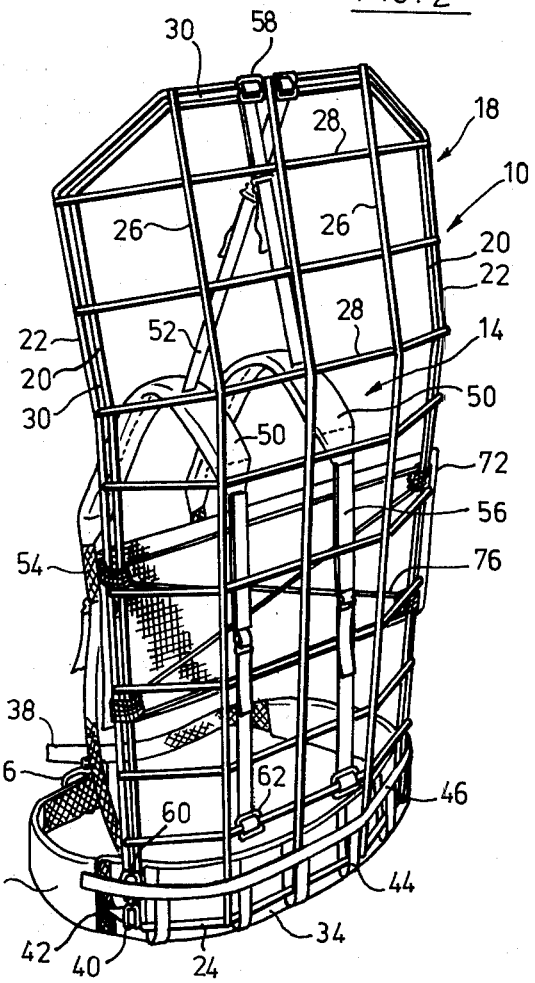

WIRE BACK PACK FRAME

CROSS-REFERENCE CO-RELATED APPLICATION

This application is a continuation-in-part of my application Ser. No. 094,146, filed Nov. 14, 1979, now abandoned.

FIELD OF THE INVENTION

The present invention is concerned with improvements in or relating to backpack frames, that is to say frames of the type intended to be carried on the back of a person, supported from the waist and shoulders, the frame supporting one or more packs, etc.

REVIEW OF THE PRIOR ART

In recent years there has been a steadily increasing interest in back-packing and similar pursuits requiring a human to carry relatively heavy loads, and this has resulted in a corresponding increase in interest in designing back pack frames that are efficient, light in weight and low in cost. Originally back pack frames were primarily of wood but with the advent of relatively inexpensive hollow metal tubing, the latter has taken over as the principal structural material, at least for the frame perimeter members. Solid rods frequently are used for some of the auxiliary frame members that cross between the perimeter members, and occasionally a wire or wires are used in some minor function.

DEFINITION OF THE INVENTION

It is the principal object of the invention to provide a backpack frame in which all of the frame members are solid drawn wires.

In accordance with the present invention there is provided a backpack frame comprising:

(a) a frame member having a frame perimeter member, the said frame perimeter member having two generally vertical sides and two generally horizontal sides connecting the said vertical sides, said vertical and horizontal perimeter member sides being constituted by respective portions of a first solid wire, and a wire frame grid extending between the said frame perimeter member sides and connected thereto, the wire frame grid comprising:

a plurality of spaced second solid wires extending between the perimeter member sides and fastened at their ends to the perimeter member sides, and a plurality of spaced third solid wires extending between the perimeter member sides transverse to the plurality of second wires and fastened at their ends to the perimeter member sides, the said second wires being fastened to the said third wires at each junction of a second wire with a third wire, (b) a shoulder harness attached to the frame member, and (c) a belt harness attached to the frame member.

Preferably each of said solid first, second and third wires are individually bendable for adjustment of the frame shape, while providing the required rigidity for the entire frame as a result of their interconnection with one another.

Preferably the frame perimeter member is elongated with the said second wires generally parallel to the member vertical sides, and with the said third wires generally parallel to the frame member horizontal sides, the second wires being longer than the third wires.

Also, preferably, the frame perimeter member comprises two closely spaced parallel first wires extending along at least the two vertical sides and providing corresponding slot portions between them, the first wires both being fastened to the second and third wires are each junction of a first wire with a second and third wire.

DESCRIPTION OF THE DRAWINGS

Backpack frames which are particular preferred embodiments of the invention will now be described, by way of example, with reference to the accompanying diagrammatic drawings, wherein:

FIG. 1 is a side elevation showing an individual wearing a first backpack frame of the invention, with just one pack mounted thereon, FIG. 2 is a general perspective view of the backpack frame along of FIG. 1, taken from the rear and slightly above, FIG. 4 is a perspective view to an enlarged scale to show in detail the method of fastening a pack to the frame perimeter member, FIG. 5 is a similar view to FIG. 4 to show in detail a method of fastening a belt to the frame perimeter member.

Similar parts of the two embodiments are given the same reference number.

DESCRIPTION OF THE PREFERRED EMBODIMENTS

Figure 3:
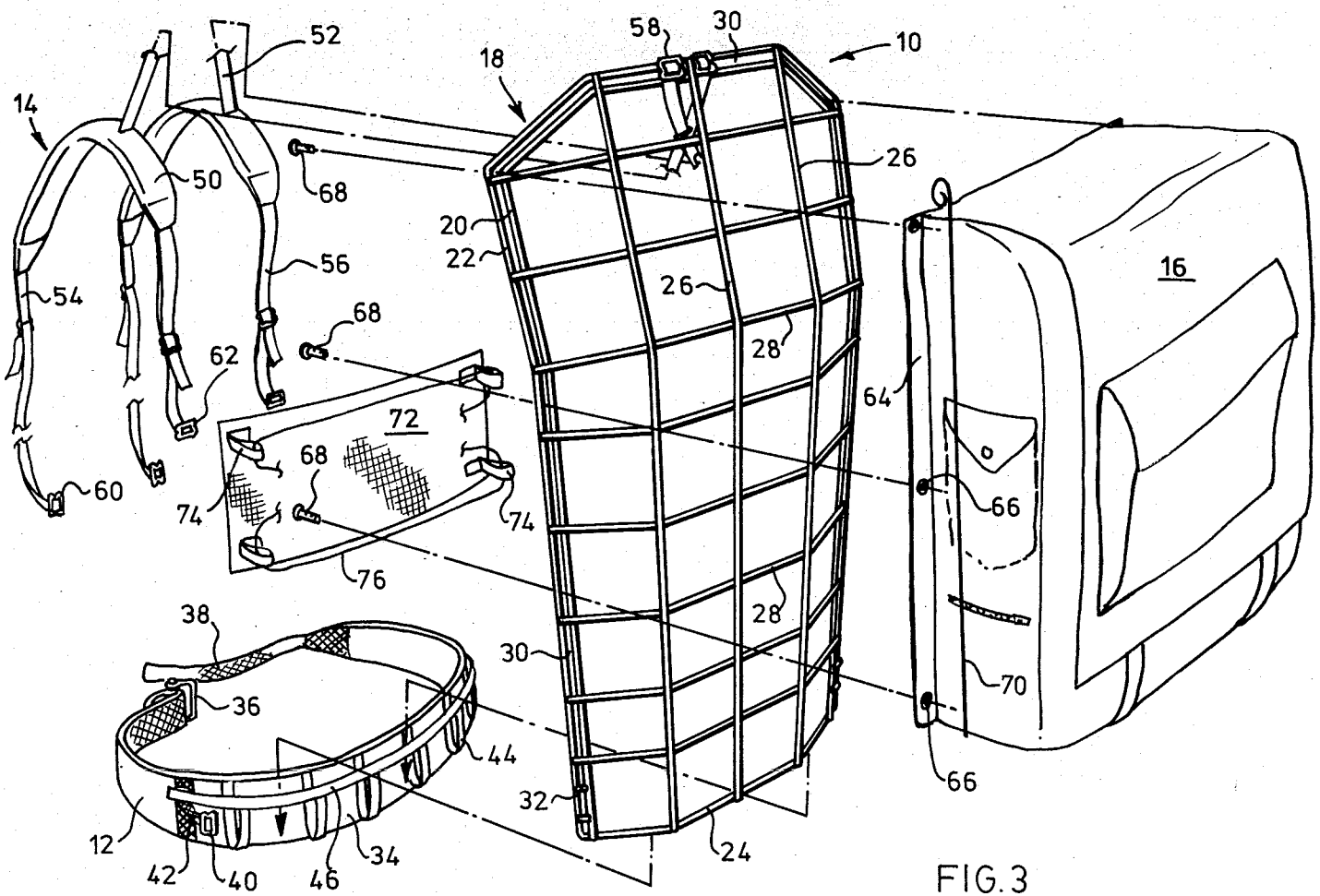
FIG. 3 is a perspective exploded view of the backpack frame and pack of FIG. 1 showing the different elements thereof separated for clarity of illustration, and in order to illustrate the method of fastening the different elements to the frame member.

A wire backpack frame of the invention as illustrated by FIGS. 1–5, consists of a frame member 10 to which is fastened a belt harness 12 (FIG. 3) and a shoulder harness 14, the frame in this embodiment being shown as having only a single pack 16 mounted thereon near to its upper end, so as not to obscure the view of the shoulder and belt harness fastenings, etc. The frame member consists of a perimeter frame member 18 which in this embodiment comprises two parallel closely spaced first, solid wires 20 and 22, both of which extend in what may be called a U-shape formation over the two longer vertical sides of the frame member and the top horizontal shorter side. The lower horizontal side of the frame is constituted by an extension of wire 20 extending between and fastened to the lower ends of the two wires 20 and 22. A wire grid extending between and connected to the sides of the frame perimeter member to complete the frame comprises a first plurality of generally-parallel vertically-extending second, solid wires 26, which are crossed at right angles by a second plurality of generally-parallel horizontally-extending third, solid wires 28. Each of the wires 20, 22, 26 and 28 is fastened or otherwise connected to the wires that it intersects at each junction between two such wires, for example by spot welding or a suitable adhesive. The top ends of the vertical wires 26, and both ends of the horizontal wires 28, bridge an elongated narrow slot 30 between the two wires 20 and 22 and divide the slot into a number of smaller elongated slot portions, each of which is bounded by the respective four wires. The two lowermost slot portions are further subdivided into three smaller sub-portions by two short supplementary wires 32. As illustrated, the wires are bent so that the frame member is contoured to the shape of the body of the wearer, the top part thereof being bent forwardly, as the frame is worn by a person, so as to move the center of gravity of the backpack closer to the center of gravity of the wearer.

In this particular embodiment the belt harness 12 consists of a padded central belt portion 34 having a front fastening buckle 36 and strap 38. The belt harness is fastened to the wire frame member by use of two belt buckles 40, each of which is connected to the central padded portion 34 by a strap 42. Each buckle is of a size that with its strap connected thereto it can readily be slipped through the slot 30 only while in an edgewise attitude, and cannot pass through in any other attitude. Each buckle 40 is slipped edgewise into the bottommost sub-portion of the perimeter slot and, upon pulling back upon the strap 42, will engage the wires 20 and 22, so that it cannot return through the slot 30 until grasped by the wearer and turned again to a sufficiently edgewise attitude. The padded belt portion 34 is retained against the bottom edge of the frame member by a series of straps 44 which are looped around wire 24 and connected at their free ends by strap 46, the ends of which are stitched to the belt portion 34, the straps 44 and 46 thereby effectively forming a pocket into which the bottom end of the frame extends.

The shoulder harness 14 consists of two padded shoulder-engaging members 50, each of which is connected to the frame by three adjustable-length straps 52, 54 and 56 respectively, the three straps together connecting the padded members to the frame member to form a three-point suspension that, in known manner, permits the weight of the frame and its packs, etc., mounted thereon to be distributed as desired between the belt harness and the shoulder harness for the comfort of the wearer. Each adjustable-length strap terminates in a respective buckle 58, 60 and 62, each of which is employed to fasten its respective strap end to the frame member. The two buckles 58 and 60 are passed edgewise through the perimeter slot 30, as described above, while the straps 56 are simply looped about an appropriate wire of the frame and then passed back through the buckles 62 to provide self-tightening loops.

A particularly rapid and effective method of fastening the pack 16 to the frame member is illustrated by FIGS. 3 and 4. The pack is provided with two vertical protruding edges 64, each of which has a plurality of vertically-spaced grommeted apertures 66. A headed pin 68 is passed through the respective slot portion 30 and also passes through a respective grommet. The shank of each pin 68 is provided with a hole through which is then passed a single longitudinal locking wire 70. In this embodiment a single wire 70 is used to retain all of the pins on one side, but it will be apparent that individual split pins may be employed instead. It will be noted that the topmost headed pin is wedged against the uppermost horizontal wire 28, so that the pack is held securely to the top of the frame. It will be apparent that packs and the like of different sizes, particularly packs of different vertical lengths, can easily be accommodated on the frame, since the substantially continuous but segmented perimeter slot provides for the mounting of each pack at any vertical position on the frame. More sub-divided slot portions may be provided as required by the provisions of additional supplementary wires 32.

A band 72 of mesh fabric is provided positioned at the small of the wearer's back to provide for ventilation at this point; this is provided at its ends with loops 74 which are then looped around the two perimeter wires 20 and 22 and laced to the frame member by lace 76.

Although the wires 26 and 28 are respectively vertical and horizontal and cross each other at right angles, it will be apparent that a wire grid can be used in which this is not the case, the wires being inclined to each other at some other angle. The wires of the frame member can be covered, preferably subsequent to assembly thereof, with a suitable coating material such as a plastisol or paint for both decorative and protective purposes. All of the solid wires can be of the same diameter material, but it will be apparent that this need not always be the case and the exact selection of wire sizes will depend upon the load intended to be carried by the backpack, consistent with the need for adequate strength with the lightest possible weight. In this particular embodiment the horizontal wires 24 and 28 and the perimeter wires 20 and 22 are all about 4.06 mm (0.160 in.) diameter, while the vertical wires 26 are about 4.47 mm (0.176 in.) diameter, all of these wires being of drawn medium carbon steel material. In the second embodiment described below, all of the wires are of the same diameter and are even smaller in diameter, namely 3.65 mm. (0.144 in) at least partly, because of the tensioned construction employed. Smaller wire diameter can be used, for example, 3.25 mm (0.128 in), if a steel of higher tensile strength is used, but such materials are somewhat more difficult to weld with consequent increases in manufacturing cost.

Figure 6:
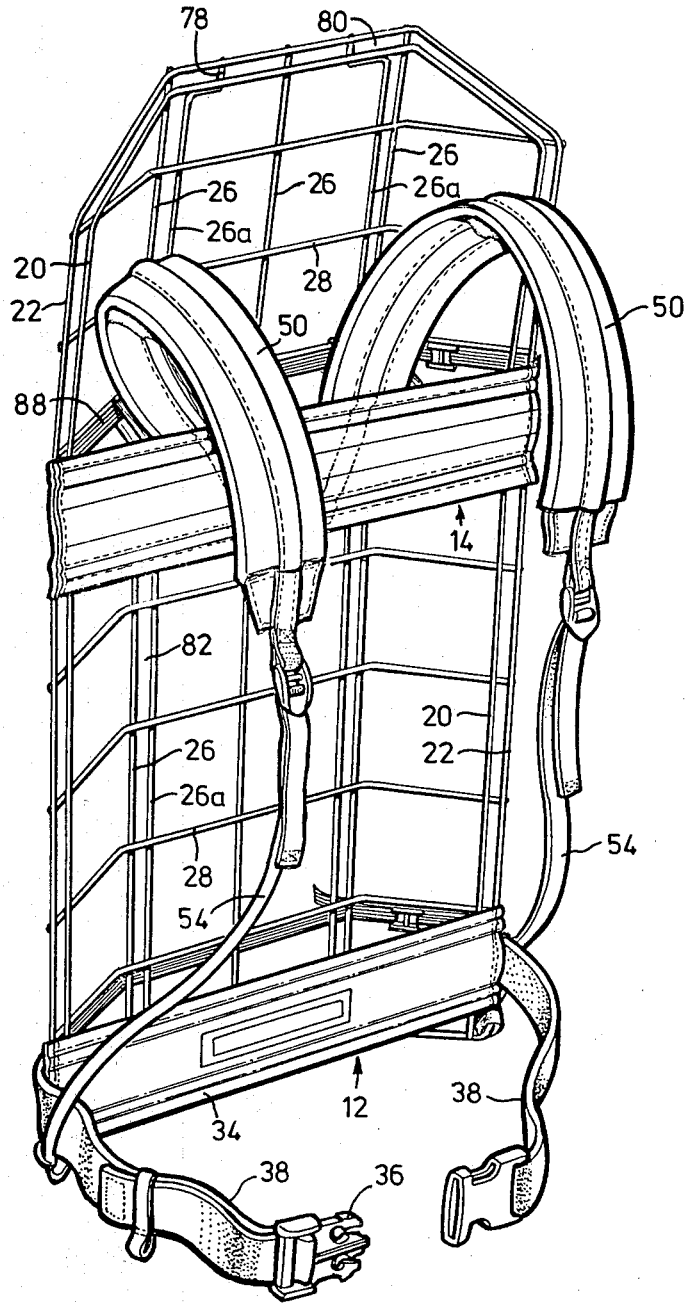
FIG. 6 is a rear perspective view similar to FIG. 2 of a second embodiment of the invention.
Figure 7:
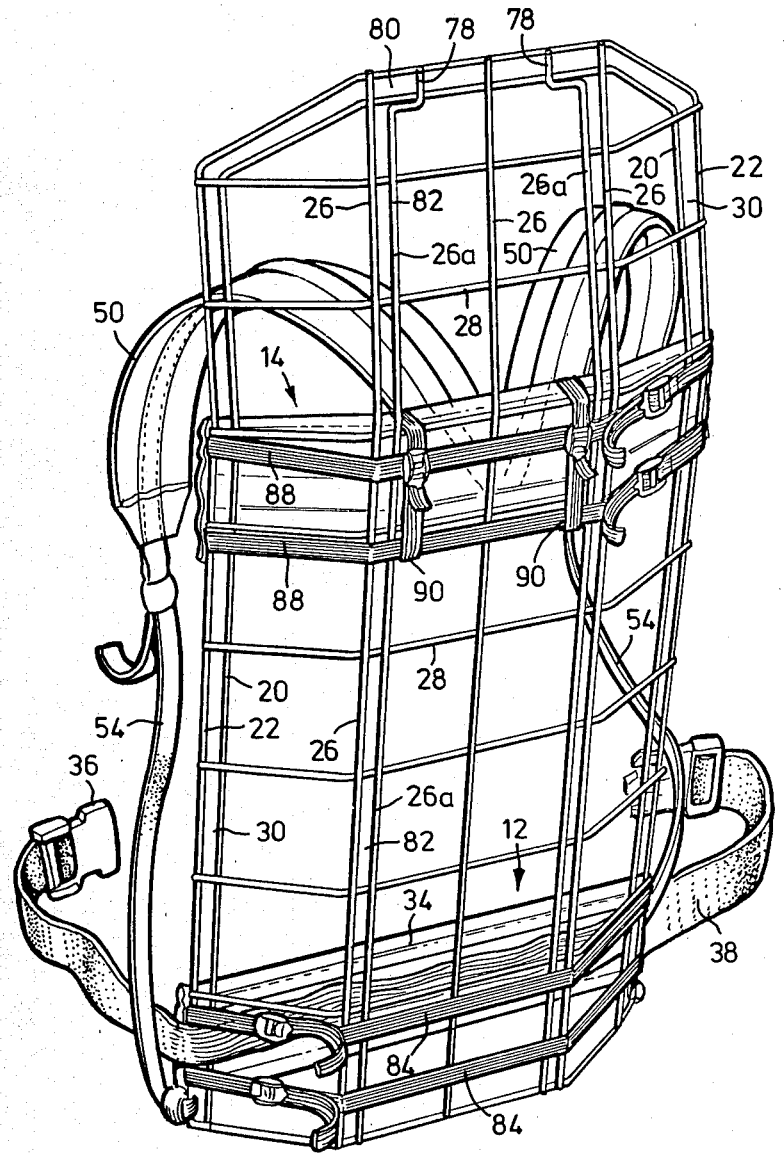
FIG. 7 is a front perspective view of the backpack frame of FIG. 6.

Referring now to FIGS. 6 and 7 the wire grid thereof differs from that of the embodiment of FIGS. 1–5 in that the two outermost of the three vertical wires 26 are each replaced by two closely-spaced solid wires 26 and 26*a*, the upper ends 78 of which are jogged to provide buckle receiving slots 80. It will be noted that in the first described embodiment the vertical wires 26 were of somewhat larger diameter than the horizontal wires, but this is not necessary in the second embodiment, and all of the wires of the frame can be of the same diameter, with the added provision of two vertical buckle-receiving slots 82. It will also be noted that the belt harness 12 now consists of a padded central belt portion 34 in the front of the frame and having the strap 38 fastened thereto, together with two straps 84 which pass behind the frame, so that the portion 34 and the straps 84 together encircle the frame member. The straps 84 are tightened to apply transverse tension to the frame and thereby render it more rigid. Similarly the shoulder harness 14 now consists of a front padded portion 86 to which the two shoulder straps 50 are fastened, together with two horizontal straps 88 behind the frame so that together with the front portion 86 they encircle the frame and can be used to apply transverse tension thereto, as with the belt harness. Two vertical straps 90 are also provided embracing two of the horizontal wires 28 to hold the shoulder harness in the desired position.

It will be seen that I have provided light-weight relatively inexpensive backpack frames which are simple to manufacture, and yet which provide for an almost infinite variety of frame shapes and of points of attachment to the frame member for various articles to be carried thereby. For example, miscellaneous items can easily be lashed to the frame at any point by means of straps, laces or strings. Because of its open mesh construction the frame has a high strength to weight ratio, and yet is relatively rigid because of the fastening of the wires together at each of the intersections or junctions thereof. The perimeter slot 30 provides an enormous number of connecting points to the frame for straps by the simple expedient described of passing the strap buckle edgewise through the slot.

This particular frame member structure permits a considerable amount of "customisation" of the frame to the wearer, which is not possible with prior art frames. Thus, the wire frame member is sufficiently rigid to carry normal loads without distortion, but the individual solid wire elements thereof are not so rigid that they cannot when required be bent, usually by hand, to a desired shape which is more closely adjusted to suit the body shape of the usual wearer of the frame. In particular, as described above, the top part of the frame can be bent forwardly to bring the center of gravity of the entire backpack closer to that of the wearer, for greater comfort in carrying a load.

Bending of this kind is not usually possible with a hollow tube element because of the danger of collapsing the tube if its modulus is exceeded, and any rod frame members are usually too rigid. This custom bending is facilitated with the embodiment of FIGS. 6 and 7, since the transverse tensioning imparts additional rigidity to the frame as a whole, without affecting the ability of bending the individual solid wire members to achieve a desired frame shape. Wire frame members of the diameter mentiond and of medium carbon steel material can usually be bent by hand by a male of average grip strength.

I claim:

1. A back pack frame comprising:

(a) a frame member having a frame perimeter member, the said frame perimeter member having two generally vertical sides and two generally horizontal sides connecting the said vertical sides, said vertical perimeter member sides each being constituted by two closely spaced parallel respective portions of first solid wire providing corresponding slot portions between them, and said horizontal perimeter member sides each also being constituted by respective portions of first solid wires, (b) a wire frame grid extending between the said frame perimeter member sides and connected thereto, the wire frame grid comprising:

a plurality of spaced second solid wires extending between the perimeter member sides and fastened at their ends to the perimeter member sides, and a plurality of spaced third solid wires extending between the perimeter member sides transverse to the plurality of second wires and fastened at their ends to the perimeter member sides, the said two closely spaced first wire portions being fastened to the second and third wires at each junction of a first wire portion with a second and third wire and the said second wires being fastened to the said third wires at each junction of a second wire with a third wire, (c) a shoulder harness attached to the frame member, and (d) a belt harness attached to the frame member.

2. A back pack frame comprising:

(a) a frame member having a frame perimeter member, the said frame perimeter member having two generally vertical sides and two generally horizontal sides connecting the said vertical sides, said vertical perimeter member sides each being constituted by two closely spaced parallel respective portions of first solid wire providing corresponding slot portions between them, and said horizontal perimeter member sides each also being constituted by respective portions of first solid wire;

(b) a wire frame grid extending between the said frame perimeter member sides and connected thereto, the wire frame grid comprising:

a plurality of spaced second solid wires extending between the perimeter member sides and fastened at their ends thereto;

a plurality of spaced third solid wires extending between the perimeter member sides transverse to the plurality of second wires and fastened at their ends to the perimeter member sides;

the said two closely spaced first wire portions being fastened to the second and third wires at each junction of a first wire portion with a second and third wire and the said second wires being fastened to the third wires at each junction of a second wire with a third wire;

each of said solid first, second and third wires being individually bendable for adjustment of the frame shape, while providing the required rigidity for the entire frame as a result of their interconnection with one another, (c) a shoulder harness attached to the frame member; and (d) a belt harness attached to the frame member.

3. A frame as claimed in claim 1 or 2, wherein the said second wires are generally parallel to one another and to the said perimeter member vertical sides, and the said third wires are generally parallel to one another, generally parallel to the said perimeter member horizontal sides, and at right angles to the said second wires.

4. A frame as claimed in claim 1 or 2, wherein the frame member is vertically elongated with the said second wires generally parallel to one another and to the member vertical sides, and with the said third wires generally parallel to one another and to the frame member horizontal sides, the second wires being longer than the third wires.

5. A frame as claimed in claim 1 or 2, wherein the top horizontal perimeter member side also comprises two closely spaced parallel first wire portiions providing a corresponding slot portion between them, the said first wire portions both being fastened to the second and third wires at each junction of a first wire portion with a second and third wire.

6. A frame as claimed in claim 1 or 2, wherein the two slot portions formed between the closely spaced parallel wire portions at the bottom of the vertical sides are subdivided by supplementary wires extending between the said first wire portions and fastened thereto.

7. A frame as claimed in claim 1 or 2, wherein the belt harness is secured to the frame member by means of belts having thereon belt buckles which can be passed through a said slot portion only while in an edgewise attitude.

8. A frame as claimed in claim 1 or 2, wherein the shoulder harness is secured to the frame member by means of belts having thereon belt buckles which can be passed through a said slot portion only while in an edgewise attitude.

9. A frame as claimed in claim 1 or 2, wherein means for fastening the pack to the frame member comprise:

a plurality of apertures in the pack member, a like plurality of headed pins, the shank of each of which can be passed through a corresponding slot portion and the head of which cannot, each pin having its shank passed through a pack aperture and a registering slot portion of the frame member, and means engaging each pin shank to prevent its withdrawal through the pack aperture and the registering frame member slot portion.

10. A frame as claimed in claim 1 or 2, wherein the said wire frame grid includes at least one pair of closely spaced parallel second wires extending generally parallel to the frame member vertical sides and providing corresponding slot portions between them.

11. A frame as claimed in claim 1 or 2, wherein the said shoulder harness and the said belt harness encircle the frame member and comprise adjustable strap means for tightening the harness around the frame member for application of transverse tension thereto.

* * * * *